US005803002A

United States Patent [19]

Faber et al.

[11] Patent Number: 5,803,002

[45] Date of Patent: Sep. 8, 1998

[54] METHOD AND APPARATUS FOR LATCHTACKING

[75] Inventors: Michael P. Faber, Rock Hill, S.C.; Stephen S. Ruderman, Matthews, N.C.; Michael J. Funke, Fort Mill; Maximillian Adamski, Jr., Tega Cay, both of S.C.

[73] Assignee: Union Special Corporation, Huntley, Ill.

[21] Appl. No.: 822,699

[22] Filed: Mar. 21, 1997

Related U.S. Application Data

[63] Continuation-in-part of Ser. No. 366,324, Dec. 29, 1994, Pat. No. 5,613,454.

[51] Int. Cl.[6] ..... D05B 65/02

[52] U.S. Cl. ..... 112/475.01; 112/288; 112/DIG. 1

[58] Field of Search ..... 112/475.01, 260, 112/287, 288, 197, DIG. 1

[56] References Cited

U.S. PATENT DOCUMENTS

| | | |
|---|---|---|
| 2,861,801 | 11/1958 | Cran . |
| 3,094,321 | 6/1963 | Kamberg . |
| 3,260,518 | 7/1966 | Kamberg et al. . |
| 3,554,354 | 1/1971 | Reid et al. . |
| 3,698,336 | 10/1972 | Launer . |
| 3,824,964 | 7/1974 | Ryan . |
| 3,874,043 | 4/1975 | Holm . |
| 4,061,327 | 12/1977 | Blessing . |
| 4,428,315 | 1/1984 | Keeton . |
| 4,460,350 | 7/1984 | Mittal et al. . |
| 4,526,115 | 7/1985 | Kosrow et al. . |
| 4,528,922 | 7/1985 | Adamski et al. . |
| 4,530,295 | 7/1985 | Adamski et al. . |
| 4,531,721 | 7/1985 | Kosrow . |
| 4,587,913 | 5/1986 | Yin et al. . |
| 4,679,515 | 7/1987 | Keeton . |
| 4,738,210 | 4/1988 | Keeton . |
| 4,763,590 | 8/1988 | Kojima et al. . |
| 4,784,381 | 11/1988 | Prochut et al. . |
| 4,796,552 | 1/1989 | Adamski, Jr. . |
| 4,800,830 | 1/1989 | Adamski et al. . |
| 4,819,926 | 4/1989 | Kosrow et al. . |
| 4,825,785 | 5/1989 | Adamski, Jr. . |
| 4,858,546 | 8/1989 | Adamski et al. . |
| 4,896,619 | 1/1990 | Adamski et al. . |
| 4,911,092 | 3/1990 | Adamski, Jr. et al. . |
| 4,922,842 | 5/1990 | Adamski et al. . |
| 4,928,610 | 5/1990 | Akutsu . |
| 4,934,293 | 6/1990 | Yokata et al. ..... 112/DIG. 1 X |
| 4,972,787 | 11/1990 | Adamski et al. . |
| 5,108,017 | 4/1992 | Adamski, Jr. et al. . |
| 5,119,747 | 6/1992 | Nishiura et al. ..... 112/DIG. 1 X |
| 5,152,235 | 10/1992 | Goto et al. . |
| 5,159,874 | 11/1992 | Adamski, Jr. et al. . |
| 5,159,889 | 11/1992 | Price et al. . |
| 5,203,270 | 4/1993 | Price et al. . |
| 5,226,378 | 7/1993 | Suzuki et al. . |

FOREIGN PATENT DOCUMENTS

| | | |
|---|---|---|
| 0208754 | 8/1990 | European Pat. Off. . |
| 6928282 | 7/1969 | Germany . |
| 1610754 | 2/1971 | Germany . |
| 3347648A1 | 7/1984 | Germany . |
| 3617572A1 | 1/1987 | Germany . |
| 8700117U1 | 6/1987 | Germany . |

*Primary Examiner*—Peter Nerbun
*Attorney, Agent, or Firm*—Brinks Hofer Gilson & Lione

[57] ABSTRACT

An apparatus and method is provided for a less costly and more reliable latchtacking technique that produces a finished work piece that is esthetically superior to the work piece that is produced by the current technique. A chain cutter has miniaturized cutting blades located at the back edge of the chaining tongue such that a relatively short unstretched chain is cut. The chain is not stretched because, stitch Also at the time the chain is cut, the vacuum in the hollow chaining tongue has been turned off. The tension on the needle thread is adjusted when chaining begins such that a short pliable balanced chain is produced which results in a more reliable technique and a latchtack that is esthetically superior to prior art latchtacks.

7 Claims, 6 Drawing Sheets

METHOD AND APPARATUS FOR LATCHTACKING

CROSS-REFERENCES

This application is a continuation in part application of application Ser. No. 08/366,324, Dec. 29, 1994 U.S. Pat. No. 5,613,454 on Mar. 25, 1997.

BACKGROUND OF THE INVENTION

The present invention relates to a method and apparatus for latchtacking the chain of stitches formed at the completion of a work piece into the beginning of the new seam in the next work piece. When sewing, for example the longitudinal seam on a garment sleeve, a seam chain is produced at the completion of the seam that extends from the trailing edge of the garment. This chain is severed from the completed garment piece and the remainder of the chain extends to the needle and other stitch forming implements. The remaining chain, can be folded back upon the top surface of the next garment piece to be sewn. When seaming of the next garment piece commences the remaining chain is covered by the seam. U.S. patent application Ser. No. 08/608,057 discloses, a sewing machine for hemming, folding and seaming garment sleeves. U.S. patent application Ser. No. 08/608,057 is by reference hereby included as a part of this application.

Generally, a sewing machine for forming an overedge chain stitch has a sewing needle, loopers, and a chaining tongue that cooperate to form the thread chain. The sewing machine also includes a presser foot, feed dogs and a throat plate that function to cyclically advance a work piece through the stitch forming region. The chaining tongue, which acts as if a knitting needle around which the thread chain is formed, and is typically part of the throat plate.

In sewing a series of work pieces with a manual, semi-automatic or automatic sewing machine that produces an overedge chain stitch in the work pieces, the sewing machine continues its sewing operation for a time after the work piece has passed through the stitch forming region of the sewing machine. This continued operation of the sewing machine creates a thread chain extending back toward the sewing needles from the trailing edge of the completed work piece.

The thread chain is severed from the completed work piece, after which a portion of the thread chain remains attached to the sewing needle and other stitch forming implements. This portion of the thread chain will then become attached to the leading edge of the next work piece passing through the stitch forming region.

In order to improve the appearance of the finished work pieces and to prevent unraveling of the seams, the portion of the thread chain attached to the sewing needle must be positioned and retained upstream along the line of feed of the sewing needle. The thread chain is positioned so that it will be oversewn into the seam beginning at the leading edge of the next work piece. The process of oversewing the thread chain into a seam at a leading edge of a work piece is known as latchtacking.

There are known devices for retaining and positioning a portion of a thread chain to be oversewn into a seam at the leading edge of a work piece. U.S. Pat. No. 4,038,933 to Marforio includes a vacuum operated device for latchtacking a thread chain. A throat plate includes a longitudinal channel, which extends through the entire length of the throat plate and a chaining tongue. The longitudinal channel is coupled by a conduit to a switching valve. The switching valve is coupled by a second conduit to a vacuum unit. A trim knife is located adjacent to the throat plate.

A disadvantage of the Marforio device is that the vacuum is supplied to the throat plate through the switching valve. The switching valve will typically have small vacuum passageways that may become clogged or partially blocked by lint, dust, thread pieces and the like, which are ingested through the chaining tongue. In addition, the location of the switching valve may increase the distance between the vacuum unit and the throat plate. This increases the time required to obtain vacuum at the chaining tongue after the valve is switched. It is desirable to mount the vacuum source close to the chaining tongue and to precisely control the timing of the application of the vacuum.

Another disadvantage of the Marforio device is that the trim knife is positioned to the right of the straight longitudinal channel. The trim knife trims the edges of the work piece before the work piece reaches the sewing needles. Because the trim knife is positioned to the right of the longitudinal channel, the resulting seam width size may be unacceptable on many work pieces.

U.S. Pat. No. 5,159,889, to Price et al, also includes a vacuum operated device for latchtacking a thread chain. A throat plate includes an air conduit that terminates in an opening at a chaining tongue. The air conduit extends from the throat plate to a vacuum canister, where the air conduit is coupled to an internal control valve assembly suspended from the lid of the canister. When the internal control valve is open, reduced air pressure within the canister draws an air stream through the air conduit. The reduced air pressure within the canister is established by coupling the canister to an inlet conduit of a venturi. The venturi is coupled to a high pressure air line by a valve.

A disadvantage of the Price device is that the vacuum canister is physically large making mounting close to the throat plate difficult. In addition, the vacuum canister requires regular maintenance to remove the lint, dust, thread pieces and the like that are drawn through the opening in the air conduit and into the canister. Furthermore, because vacuum is drawn through the internal control valve assembly, the presence of such debris on the valve element of the internal control valve assembly may prevent the internal control valve from completely closing. It is desirable to mount the vacuum source close to the chaining tongue and to minimize required maintenance.

A further disadvantage of the Price device is that two valves are utilized, the internal control valve assembly and the valve coupling the venturi to the high pressure line. It is desirable to minimize the number of components used in the vacuum system. In addition, the time required to evacuate the canister with this valve arrangement may limit the number of work pieces that can be produced in a given time. Also the chain cutter is located a substantial distance to the rear of the throat plate and as a result the thread chain that must be latchtacked is very long.

Another known device for retaining and positioning a portion of a thread chain to be oversewn into a seam at the leading edge of a work piece is available from Atlanta Attachment Company of Lawrenceville, Ga. The device includes a thin-walled vacuum tube that is soldered to the underside of the throat plate and chaining tongue. The thin-walled vacuum tube is soldered to a vacuum conduit at the front edge of the throat plate.

A disadvantage of this device is that the chaining tongue may not be hardened and polished after the thin-walled vacuum tubing is soldered in place. It is desirable to harden and Polish all surfaces of the chaining tongue because the thread chain is formed around the chaining tongue and should smoothly slide over the chaining tongue. Surfaces of the chaining tongue that have not been hardened are subject to needle nicks, which may cause the thread chain to snag and necessitate replacement of the entire throat plate. In addition, with the thin walled tubing, which is formed and then soldered in place, the chaining tongues on a series of throat plates may not be consistently dimensioned, leading to greater set up times when replacing a throat plate. Furthermore, the vacuum conduit may not be readily reformed or repositioned.

In the prior art the completed garment piece is conveyed along the stitch line, away from the stitch forming region, at a faster rate than the stitch forming rate. This causes the chain that is formed to be stretched. This faster feed rate can be automatically initiated for example by a signal to the operating system that is generated in response to sensing the trailing edge of the completed garment piece. The base of the chain is formed over a hollow chaining tongue that is open at its free end. The typical chaining tongue is formed integral with the throat plate. A vacuum source is connected to the chaining tongue which creates a stream of air that flows in the open end of the chaining tongue. The signal that is generated in response to sensing the trailing edge of the completed garment piece can also activate a cutting device that severs the chain at a predetermined distance from the back edge of the chaining tongue. This usual predetermined distance is approximately an inch which results in quite a long chain that is difficult to control. When the stretched chain is severed it snaps back toward the stitch forming zone. Since the free end of the chain is no longer constrained the portion of the chain at the back edge of the chaining tongue will now be drawn into the open end of the chaining tongue by the air stream. At this time in the cycle the free end of the chain, provided it has not become snagged or tangled, is supported on the upper surface of the throat plate. The length of chain, from the back edge of the chaining tongue to its severed end is then, provided it has not become snagged or tangled, pulled into the hollow chaining tongue by the air stream. When stitching of the next garment begins the thread chain is gradually pulled out of the chaining tongue and the seam being formed covers the chain at the stitch forming region which is located at the base of the chaining tongue. This conventional practice is called latchtacking. For this conventional latchtacking practice to be successful, the loose unconstrained end of the cut chain must be pulled into the open end of the chaining tongue. However, the relative long unconstrained section of chain that snaps back when it is severed often becomes snagged or tangled and as a result is prevented from being pulled into the open end of the chaining tongue. In order to assure proper latchtacking operation a relatively high vacuum differential must be maintained for a relatively long time period. Maintaining this vacuum for the required time period requires substantial power use that increases the operating cost. The long chain, which contributes nothing to the desirability of the finished product, and is a waste of thread. The long thread chain contained in a latchtack in fact detracts from the esthetics quality of the work piece.

When the seam in a work piece is completed and chaining begins the tension on the threads is no longer proper. A thread tension change for the looper thread or threads is required to produce a balanced thread chain. The tension for the needle thread, while producing a seam, is set to feed the proper length of thread to produce an unbalanced stitch. Since the needle thread passes through the fabric it encounters frictional resistance during the stitch forming process. The looper thread or threads on the other hand do not pass throughout the fabric and the resistance on these threads do not change when changing from seaming to chaining. Thus, the tension on the looper thread or threads is adjusted when chaining is initiated causing the stitch chain to be balanced. A balanced stitch chain is more pliable and thus more inclined to be sucked into the opening in the chaining tongue.

Thus, there is a need for a less costly latchtacking technique that is more reliable, and produces a finished work piece that is esthetically superior to the work piece that is produced by the current technique.

SUMMARY OF THE INVENTION

The present invention is directed to an apparatus and method that satisfies the need for a less costly latchtacking technique that is more reliable, and produces a finished work piece that is esthetically superior to the work piece that is produced by the current technique.

An advantage of this invention is that latchtacking can be performed using less power, and waste less thread. Thus, this invention provides a more economical method of producing a latchtack.

Another advantage of this invention is that it is more reliable and as a result of using this invention there will be fewer rejected work pieces.

Still another advantage of this invention is that the resulting finished product is more esthetically pleasing to the consumer.

This invention consist of a chain cutter that cuts a relatively short unstretched chain.

This invention further consist of locating the chain cutter at the back edge of the chaining tongue.

This invention also consist of producing a latchtack that includes a very short chain length and is thus esthetically pleasing.

This invention consist of a method for latchtacking in which the chain is not stretched prior to being cut.

This invention further consist of a method for latchtacking in which stitching ceases prior to the chain being cut.

This invention still further consist of a method for latchtacking in which there is no vacuum in the chaining tongue while the chain is being cut.

This invention consist of producing a latchtack that is more reliable than produced by the prior art latchtacking technique.

This invention also consist of a latching technique in which the tension on the needle and looper thread is adjusted when chaining begins such that a short pliable balanced chain is produced which results in a more reliable technique and a latchtack that is esthetically superior to prior art latchtacks.

The current invention involves a throat plate including a throat plate body having a first internal bore beginning at a front edge of the throat plate body and extending longitudinally there through, and a channel formed in the lower surface of the throat plate body. The throat plate further includes a chaining tongue having a front edge and back edge, where the chaining tongue is integrally formed with the throat plate body. The chaining tongue has a second internal bore beginning at the back edge of the chaining tongue and extends for a distance longitudinally through the chaining tongue and to the throat plate body where the channel couples the second internal bore to the first internal bore.

In another aspect of the invention, a vacuum generating system applies vacuum to the back edge of a chaining tongue at the location of the thread chain cutter. The vacuum generating system includes a source of positive pressure gas, a vacuum generator having an input port, an outlet port and a vacuum port, and a valve for coupling the source to the input port of the vacuum generator. The valve is controllable. The vacuum generating system further includes a conduit coupling the vacuum port of the-vacuum generator to the throat plate.

DETAILED DESCRIPTION OF THE PREFERRED EMBODIMENT

Figure 1A:
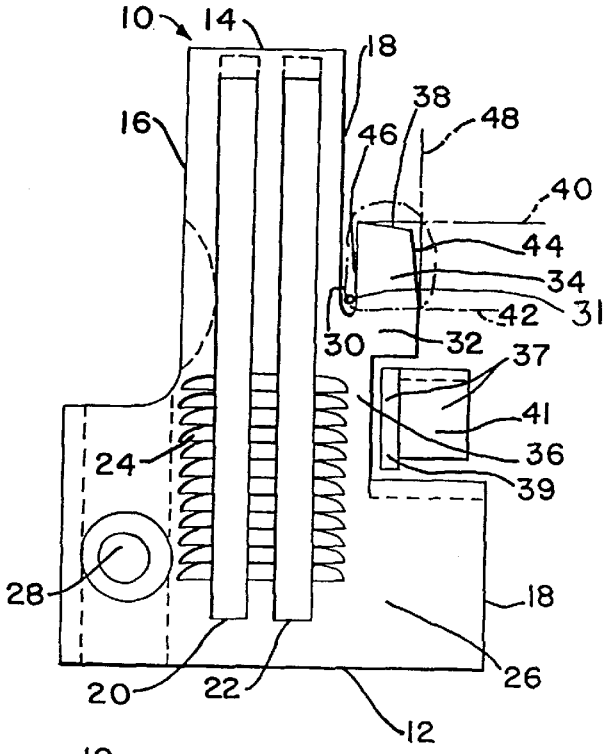
FIG. 1A is a top view of a throat plate in accordance with the present invention.

An embodiment of the present invention is best understood by reference to the embodiments shown in FIGS. 1A through 4 in which like elements are referred to by like numerals. FIG. 1A is a top view of a throat plate 10 in accordance with this embodiment of the invention. The throat plate 10 has a front edge 12, a back edge 14, a left edge 16 and a right edge 18. Two longitudinal closed slots 20 and 22 are machined into the throat plate 10. Twelve grooves 24, oriented substantially perpendicular to the slots 20 and 22, are cut into an upper surface 26 of the throat plate 10. A screw may be driven through a mounting hole 28 to secure the throat plate 10 to the bed of a sewing machine (not shown). The slots 20, 22 and grooves 24 operatively associate with a presser foot and feed dogs in a conventional manner to cyclically advance a work piece 29, as shown in FIG. 1D, through a stitch forming region 30.

The throat plate shown in the accompanying Figures may be used with a Model 39500 over edge sewing machine manufactured by Union Special Corporation. The Model 39500 over edge sewing machine may produce a class 503 or a class 504 sewing stitch, and may be adapted for manual or automatic operation. U.S. Pat. No. 4,796,552 discloses a sewing machine of the Model 39500 type, and this patent is by reference hereby included as a part of this disclosure. Alternatively, the invention may be adapted for use on other sewing machines, including sewing machines for producing other classes of sewing stitches, to perform the latchtack function.

Referring again to FIG. 1A, a platform 32 extends from the right edge 18 of the throat plate 10. A chaining tongue 34 extends generally toward the back edge 14 of the throat plate 10 from the platform 32. The portion of the throat plate 10 exclusive of the chaining tongue 34 is referred to herein as a body 36 of the throat plate 10. Thus, the platform 32 is part of the body 36 of the throat plate 10.

Figure 1B:
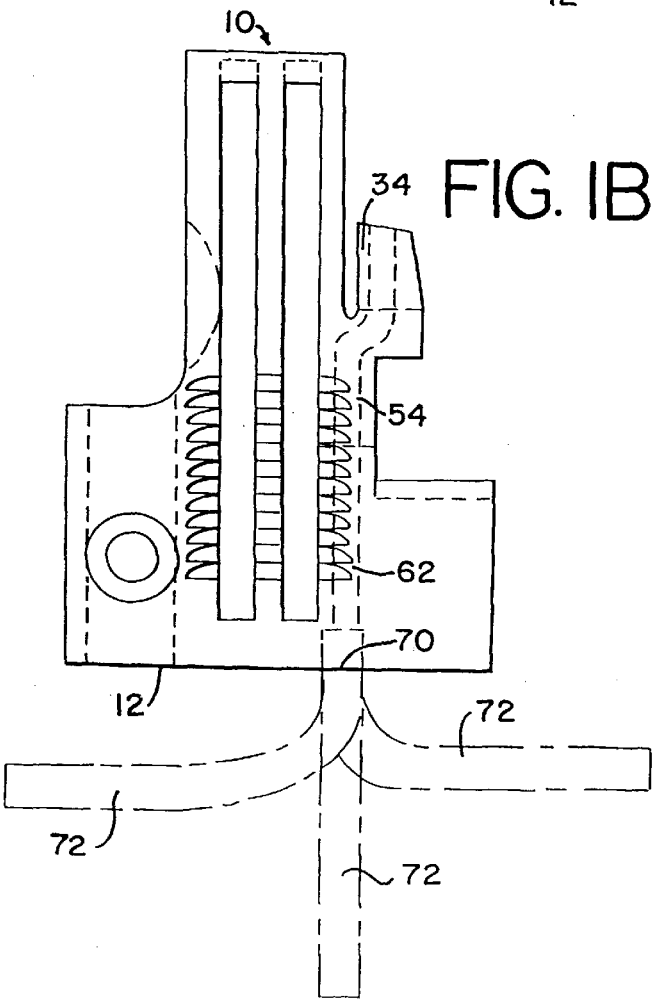
FIGS. 1B and 1C illustrate alternative configurations for a vacuum conduit attached to the throat plate of FIG. 1A.
Figure 1C:
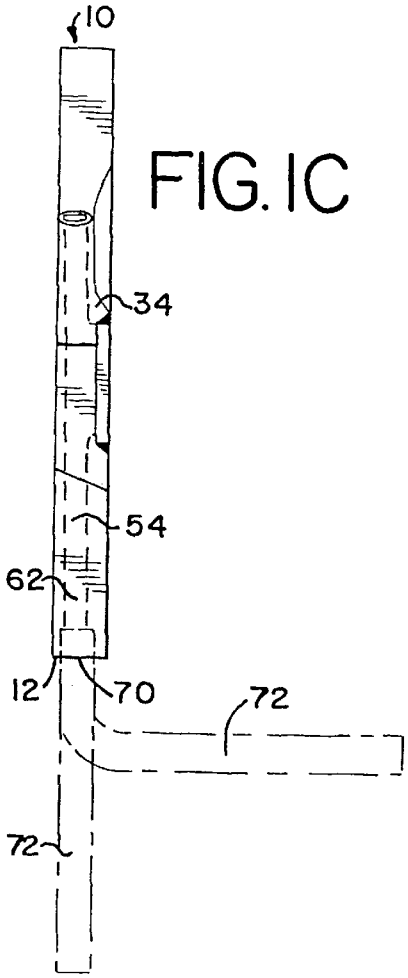
Figure 1D:
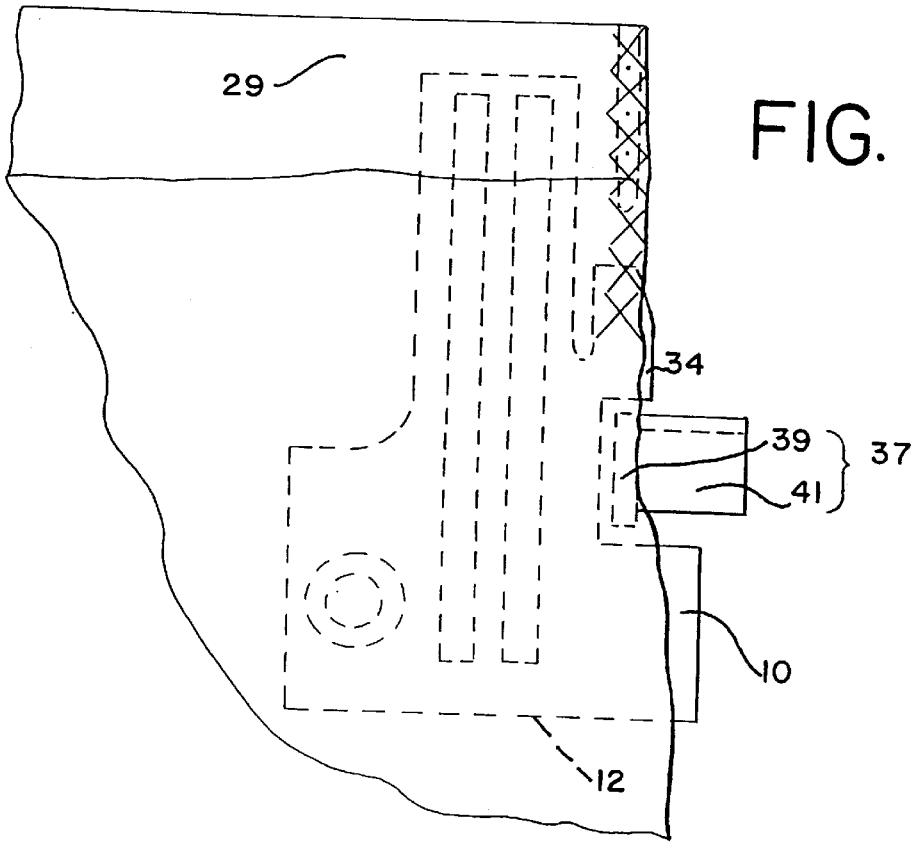
FIG. 1D is a top view of a work piece advancing over the throat plate of FIG. 1A and being trimmed by a trim knife.

A trim knife 37 may be mounted adjacent to the body 36 of the throat plate 10 in the notch to the front of the platform 32. Trim knife 37 functions to trim the edges of the fabric being sewn. The trim knife 37 includes a lower stationary blade 39 and an upper moving blade 41. The location of the trim knife 37, as shown in FIG. 1D, in front of the chaining tongue 34 provides a narrow seam width.

The chaining tongue 34 has a back edge 38, which is angled with respect to a line 40 parallel to the back edge 14 of the throat plate 10, as shown in FIG. 1A. The angle between the back edge 38 of the chaining tongue 34 and the line 40 is preferably 8.7 degrees, although other angles may be acceptable. The interface between the chaining tongue 34 and the platform is referred to herein as a front edge 42 of the chaining tongue 34. The chaining tongue 34 also has a right edge 44 and a left edge 46.

As shown in FIG. 1A, the right edge 44 of the chaining tongue 34 angles toward the left edge 46 of the chaining tongue 34 such that the distance between the right edge 44 and the left edge 46 is greatest at the front edge 42 of the chaining tongue 34. The angle between the right edge 44 and a line 48 perpendicular to the platform 32 is preferably 7.6 degrees, although other angles may be acceptable. The distance between the right edge 44 and the left edge 46 is referred to herein as the width of the chaining tongue 34. A needle channel is provided between the right edge 18 of the throat plate and the left edge 46 of the chaining tongue 34. The needle 31 is located in the needle channel at the base of the chaining tongue 34.

Figure 2A:
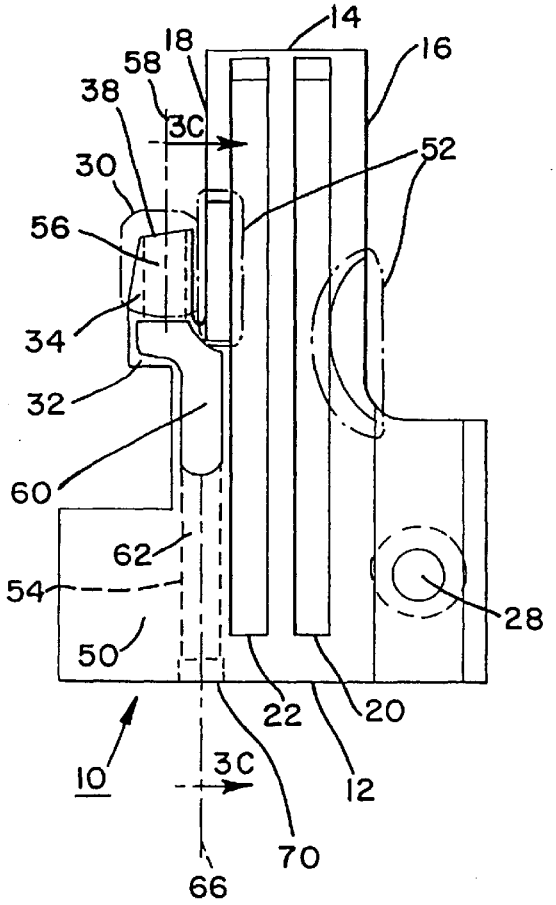
FIG. 2A is a bottom view of the throat plate shown in FIG. 1A.

FIG. 2A is a bottom view of the throat plate 10 shown in FIG. 1A. The throat plate 10 has a lower surface 50, which is preferably machined in an area 52 along the left edge 16 and the right edge 18 to prevent interference between the cyclically moving loopers (not shown) and the throat plate 10 during the sewing operation.

Figure 3A:
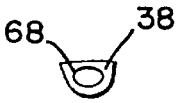
FIG. 3A is a view of a back edge of a chaining tongue on the throat plate shown in FIGS. 1A–1D and 2A–2B.
Figure 3B:
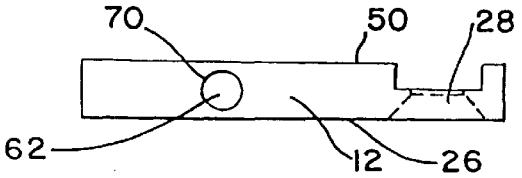
FIG. 3B is a view of a front edge of the throat plate shown in FIGS. 1A–1D and 2A.
Figure 3C:
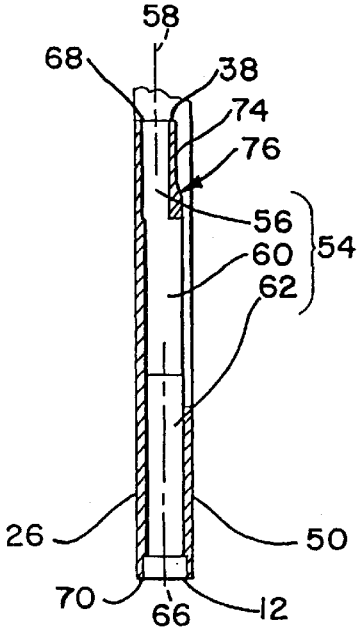
FIG. 3C is a sectional view of a vacuum passageway extending between the back edge of the chaining tongue shown in FIG. 3A and the front edge of the throat plate shown in FIG. 3B.

A vacuum passageway 54 between the front edge 12 of the throat plate 10 and the back edge 38 of the chaining tongue 34 is shown in phantom in FIG. 2A. FIG. 3C is a sectional view of the vacuum passageway 54 extending between the back edge 38 of the chaining tongue 34, as shown in FIG. 3A, and the front edge 12 of the throat plate 10, as shown in FIG. 3B. For sewing machines having the trim knife 37 positioned as shown in FIG. 1A, the vacuum passageway 54 is preferably formed from three interconnected segments.

The first segment is an internal bore 56 within the chaining tongue 34, as shown in FIG. 2A. The internal bore 56 begins at the back edge 38 of the chaining tongue 34 and extends longitudinally through the chaining tongue 34. A longitudinal axis 58 extends axially through the center of the internal bore 56. FIG. 3A is a view of the back edge 38 of the chaining tongue 34 on the throat plate 10 showing an opening 68 on the back edge 38 formed by the internal bore 56. Preferably, the internal bore 56 is formed using an electric discharge machining ("EDM") process.

As shown in FIG. 3C, the chaining tongue 34 has a lower surface 74 with a radius 76 so that the chaining tongue 34 does not interfere with the operation of the loopers (not shown). When the throat plate 10 is used with the Union Special Model 39500 sewing machine, the lower surface 74 preferably is 0.105 inches (0.267 cm) below the upper surface 26 of the throat plate 10 and the radius 76 is approximately 109 inches (0.277 cm). The dimensions are determined by the desired seam width.

The second segment of the passageway 54 is a channel 60 machined into the lower surface 50 of the throat plate 10, as shown in FIG. 2A. The channel 60 intersects the internal bore 56. Preferably, the channel 60 does not extend into the chaining tongue 34, but rather intersects the internal bore 56 on the platform 32. Prior to use of the throat plate 10, the channel 60 is sealed with a cover (not shown), which may be soldered into place or secured by other means, such as a screw. Notably, the cover for the channel 60 does not extend into the stitch forming region 30, and therefore the cover does not contact either the thread chain or the work piece during sewing. Preferably, the walls of the channel 60 are machined so that the cover fits flush with the lower surface 50 of the throat plate 10.

The third segment of the passageway 54 is an internal bore 62 within the body 36 of the throat plate 10, as shown in FIG. 2A. The internal bore 62 begins at an opening 70 on the front edge 12 of the throat plate 10, as shown in FIG. 3B, and extends longitudinally into the throat plate 10, where the internal bore 62 intersects the channel 60. A longitudinal axis 66 extends axially through the center of the internal bore 62. The internal bore 62 may be formed using EDM, drilling or other known machining techniques. Preferably, the internal bore 62 is counterbored at the front edge 12 of the throat plate 10 for attaching the throat plate to a vacuum source. The counterbored portion of the internal bore 62 may be tapped.

Because the vacuum passageway 54 includes the internal bore 56 in the chaining tongue 34, the chaining tongue 34 may be machined from the stock parent metal used for the throat plate 10. Where a throat plate body and a chaining tongue, including the upper and lower surfaces and left and right edges of the chaining tongue, are machined from the same piece of stock parent material, the chaining tongue is referred to herein as being integrally formed with the throat plate body.

Preferably, the parent material for the throat plate 10 and integrally formed chaining tongue 34 is a tool steel, such as S7 tool steel, although any other machinable and heat treatable material may alternatively be used. Since the chaining tongue 34 is integrally formed with the throat plate 10, all surfaces of the chaining tongue 34, including the left edge 46, the right edge 44, the lower surface 74, and the walls of the internal bore 56, may be heat treated and polished, although it is not necessary to heat treat the walls of the internal bore 56. Preferably, the machined throat plate 10 is heat treated to provide a hardness of HV-600 minimum and a core hardness of HRC 42 maximum.

Several advantages are realized by constructing the passageway 54 as described herein. For example, the chaining tongue 34, being hardened on all thread contacting surfaces, is more durable allowing nicks formed on the chaining tongue during its use to be removed by polishing. In addition, throat plates in accordance with the present invention may be machined with chaining tongues having consistent outer dimensions, making the throat plates more interchangeable and producing more consistent thread chains. Furthermore, because the chaining tongue 34 is entirely formed from the parent metal, the walls of the internal bore 56 may be hardened and polished to prevent snagging of the thread chain.

Moreover, because the internal bore 62 within the body 36 of the throat plate 10 provides an attachment point on the throat plate 10 for the vacuum source 64, that is, the opening 70 at the front edge 12 of the throat plate 10, the vacuum source 64 may be coupled to the internal bore 62 using any convenient or desirably shaped conduit 72. More specifically, because the conduit 72 is attached to the passageway 54, as opposed to being integrally formed with the passageway 54, the conduit 72 may be replaced or reoriented without consequence to the chaining tongue 34. Also, differently shaped conduits may be used with the throat plate 10 for different applications requiring auxiliary attachments in front of the throat plate 10. FIGS. 1B, which is a top view of the throat plate 10, and IC, which is a right side view of the throat plate 10, illustrate some of the many alternative ways that the conduit 72 may be oriented.

Figure 2B:
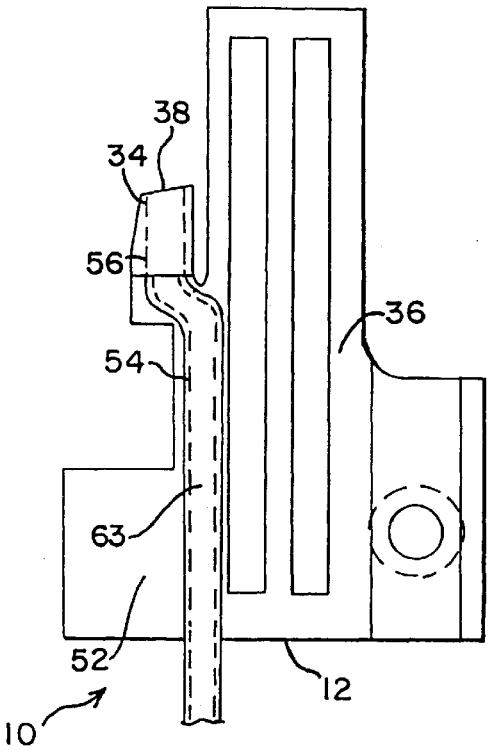
FIG. 2B is a bottom view of an alternative embodiment of the throat plate shown in FIG. 2A.

In alternative embodiments, the vacuum passageway 54 may be formed from two segments. In a first alternative embodiment, shown in FIG. 2B, the channel 60 and the internal bore 62 in the throat plate 10 are replaced by a length of soft steel tubing 63. The tubing 63, shown in FIG. 2B, is essentially formed to match the shape of the channel 60 and the internal bore 62, shown in FIG. 2A. The lower surface 50 of the body 36 is machined to accommodate the steel tubing 63, which is attached to the internal bore 56 in the chaining tongue 34. Thus, the two segments of the vacuum passageway 54 are the length of soft steel tubing 63 and the internal bore 56. In this embodiment, the steel tubing 63 may extend from the throat plate 10 to operate as the conduit 72 to the vacuum source 64. The chaining tongue 34 in the first alternative embodiment is integrally formed with the throat plate 10.

In a second alternative embodiment, the internal bore 56 in the chaining tongue 34 and the channel 60 are replaced by a formed length of soft steel tubing. The lower surface of the chaining tongue 34 and the throat plate 10 are relieved by machining to accommodate the steel tubing, which is attached to the internal bore 62 . Thus, the two segments of the vacuum passageway 54 are the length of soft steel tubing and the internal bore 62 within the body 36 of the throat plate 10.

If the trim knife 37 is not required, the vacuum passageway may be formed in a single segment. In FIG. 1A, the notch along the right edge 18 of the throat plate 10 to the front of the platform 32 may accommodate the trim knife 37. If the trim knife 37 is not required, then the notch may be eliminated and the right edge 18 to the front of the platform 32 extended to the right edge of the platform 32. The vacuum passageway 54 may then be formed by machining a bore extending from the back edge 38 of the chaining tongue 34 to the front edge 12 of the throat plate 10. The passageway 54 is preferably formed using electric discharge machining. As above, the passageway 54 may be counterbored at the front edge 12 of the throat plate 10.

Figure 4:
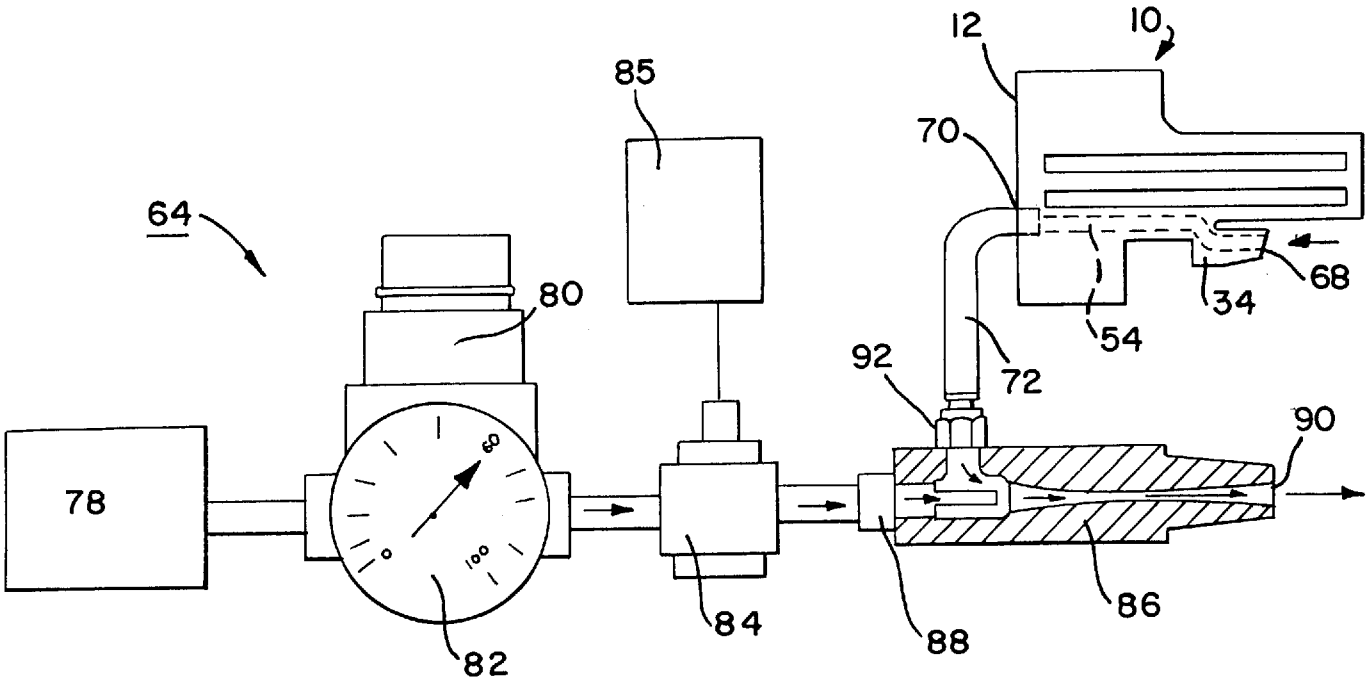
FIG. 4 is a schematic of a vacuum generating system in accordance with the present invention.

Referring now to FIG. 4, which is a schematic view of a vacuum generating system in accordance with the present invention. The vacuum generating system includes an air supply 78, which provides positive pressure. The air supply 78 is preferably coupled to a regulator 80, which may have a gage 82 or other indicator of the pressure level. The regulator 80 is coupled to a valve 84, which is coupled to a controller. The air supply 78 may alternatively be directly coupled to the controlled valve 84. When the valve 84 is open, air from the air supply 78 flows through the valve 84. When the valve 84 is closed, the air supply is cut off. The valve 84 output is coupled to a vacuum generator 86.

The vacuum generator 86 has an input port 88, an exhaust port 90 and a vacuum port 92. Between the input port 88 and the exhaust port 90, the vacuum generator 86 forms a venturi-with a straight through hole, providing a vacuum at the vacuum port 92. The vacuum generator 86 may exhaust to the atmosphere. A suitable commercially available vacuum generator 86 is supplied by Fabco-Air of Gainesville, Fla. as model VTR-1. A Series HAV Vacuum Transducer Pump as manufactured by Air-vac Engineering Co. of Milford, Conn. may alternatively be used.

The vacuum port 92 of the vacuum generator 86 is coupled by the conduit 72 to the counterbored opening 70 on the front edge 12 of the throat plate 10. Preferably, the lengths of the conduit 72 and the coupling between the vacuum generator 86 and the valve 84 are minimized. As the valve 84 is controllable, close coupling the valve 84 to the vacuum generator 86 reduces the time delay between switching open the valve 84 and obtaining a vacuum at the chaining tongue 34. The valve 84 is preferably a pneumatically actuated poppet valve, although a solenoid actuated valve may alternatively be used. The valve 84 is preferably controlled by a microprocessor having an input from a sensor, such as a retroreflective sensor, located to monitor the position of the work piece. The valve 84 may alternatively be controlled by an operator, who may throw a switch to apply the actuating signal to the valve 84.

In operation, the air supply is coupled to and flows through the vacuum generator 86 upon application of the required pressure to the pneumatically controlled valve 84. The venturi within the vacuum generator 86 generates vacuum at the vacuum port 92 as the air supply flows from the input port 88 to the exhaust port 90. The vacuum is coupled by the conduit 72 to the passageway 54 in the throat plate 10, ultimately reaching the opening 68 in the chaining tongue 34. Preferably, the openings throughout the passageway 54, the conduit 72 and the path through the vacuum generator 86, between the vacuum port 92 and the exhaust port 90, are larger than the opening 68 to prevent the vacuum generating system from becoming clogged by lint, dust, thread pieces and the like.

The vacuum at the opening 68 serves to draw the end of the portion of the severed thread chain that is attached to the sewing needle into the chaining tongue 34. By varying tension on the sewing threads prior to or in the course of chaining off the thread chain, the thread chain may be made more balanced and flexible, as is known in the art. A balanced and more flexible thread chain may be captured by the chaining tongue more consistently. In addition, it is desirable during the latchtacking operation to sever the balanced thread chain very close to the back edge 14 of the throat plate 10 in order to minimize the length of the severed thread chain and to locate the severed end of the thread chain near the opening 68 in the chaining tongue 34.

Alternatively, or in addition to varying tension on the sewing threads, the thread chain may be stretched before it is severed, as is known and described, for example, in U.S. Pat. No. 4,679,515 to Keeton or in U.S. Pat. No. 5,159,889 to Price et al., to assist in directing the portion of the severed thread chain that is attached to the sewing needle toward the opening 68 in the chaining tongue 34. Several stitches may be chained off during or immediately after severing the thread chain to ensure that the proximal end of the thread chain is located about the chaining tongue.

Figure 1E:
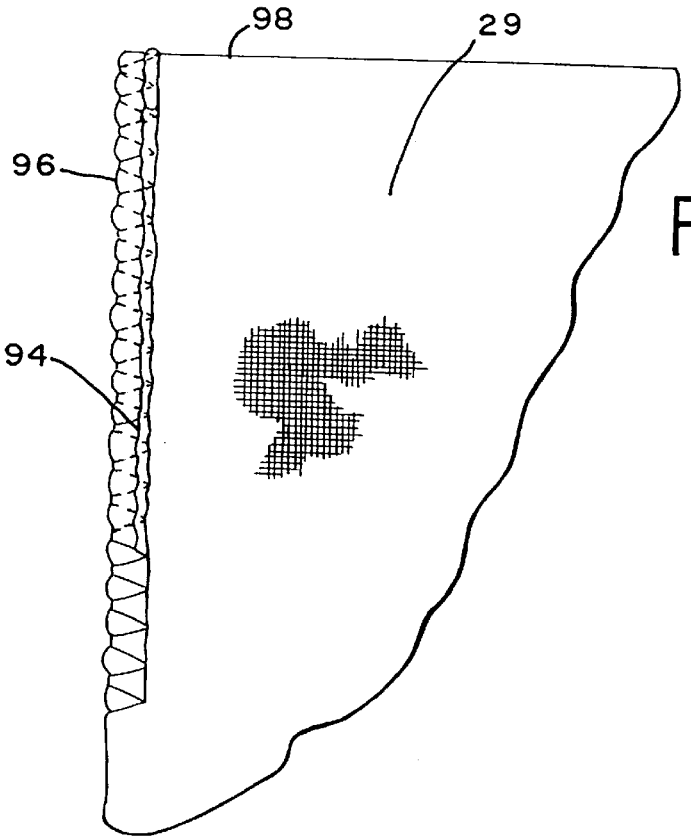
FIG. 1E is a view of a partially seamed work piece having a thread chain oversewn into the seam at a leading edge of the work piece.

The end of the thread chain is thereby positioned and retained within the chaining tongue 34 until the next work piece 29 enters the stitch forming region 30 of the sewing machine. As the work piece 29 is advanced through the stitch forming region 30, the thread chain is withdrawn from the chaining tongue 34 and oversewn into the seam at the leading edge of the work piece 29. As shown in FIG. 1E, a thread chain 94 is oversewn into a seam 96 at a leading edge 98 of the work piece 29. Preferably, vacuum is supplied by the vacuum generator 86 to the chaining tongue 34 as the advancing work piece 29 draws the thread chain out of the chaining tongue 34.

The throat plate 10, as described above, may be used in automated seaming or hemming and seaming sewing machines, as well as in manual or semi-automatic sewing workstations. As is further described above, the vacuum source 64 is preferably controlled by the microprocessor, which has an input from the sensor, such as a retroreflective sensor, located to monitor the position of the work piece. The vacuum source 64 may alternatively be controlled by the operator, who may throw a switch to apply the actuating signal to the valve 84.

Figure 5:
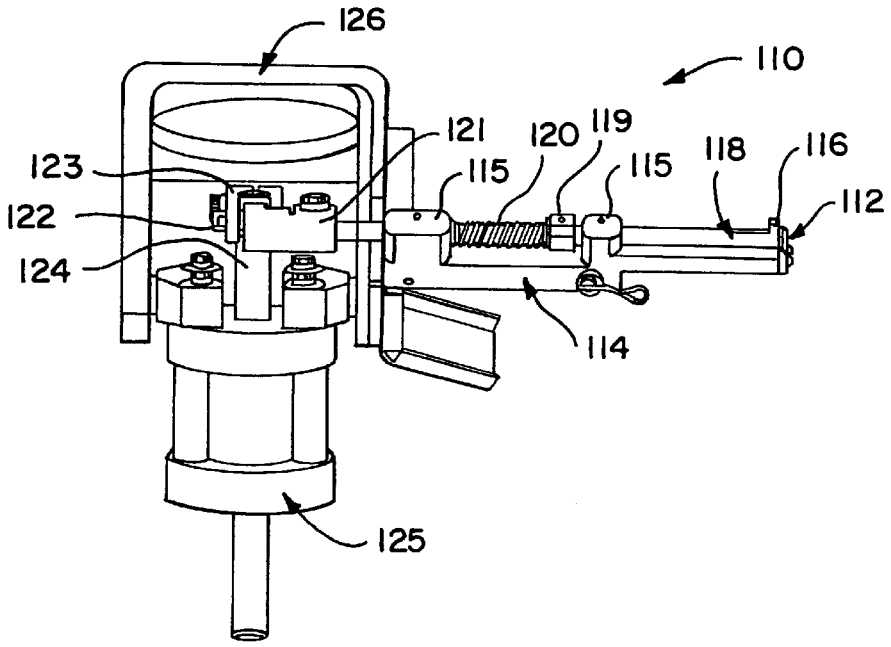
FIG. 5 is a perspective view of an embodiment of the chain cutter mechanism of this invention.

Referring to the drawings, FIG. 5 is a perspective view of the chain cutter 110 that is used in the preferred embodiment of this invention. The blades 112 and 116 of chain cutter 110 are miniature version of a conventional chain cutter of the type that is used with the embodiments of this invention discussed above and illustrated in FIGS. 1A through 4. The size of blades 112 and 116 were reduced to enable the cutter 110 to be located at the free end of the hollow chaining tongue 34 of the throat plate 10. It should be noted that the throat plate 10 as described above is used in this preferred embodiment of the invention.

The chain cutter 110 includes a stationary knife 112 that is secured by a fastener such as a screw 113 to an end portion of the cast cutter frame 114. The cast cutter frame 114 is secured to the cutter bracket 126 which is fixedly secured to the sewing machine frame. The movable knife 116 is carried at the first free end of a shaft 118. Shaft 118 is supported for rotation in cylindrical openings formed in lugs 115 that are integral with the cast cutter frame 114. A collar 119 is secured to shaft 118 between lugs 115 that serves as an adjustable stop for one end of a compression spring 120. The other end of compression spring 120 bears against one of the lugs 115 such that the movable knife 116 is biased into engagement with stationary knife 112. A link 121, which is one half of a clevis, is secured to the second free end of shaft 118. Link 121 is pivotally connected by a clevis pin 122 to link 123 which is the other half of the clevis. Link 123 is secured to the free end of a piston shaft 124 that reciprocates in the cutter cylinder 125. Cylinder 125 is mounted for articulation on the cutter bracket 126. When cylinder 125 is energized the piston shaft is extended which causes the clevis links 121 and 123 to move about clevis pin 122. The movement of link 121 imparts an articulation of shaft 118 in the cylindrical openings formed in lugs 115.

Figure 6:
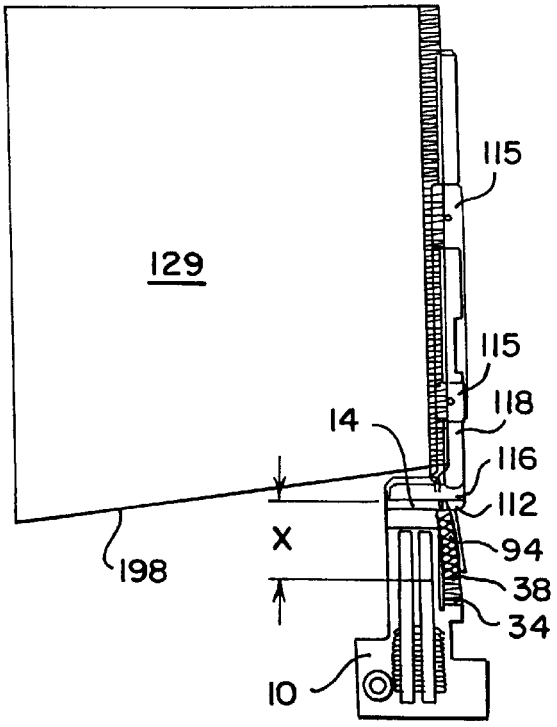
FIG. 6 is a plan view of an embodiment of this invention.

FIG. 6 is a top view illustration of the embodiments of this invention that are discussed above and illustrated in FIGS. 1A through 4. In this view the throat plate 10, hollow chaining tongue 34 and its back edge 38 are identified. Also identified in this view is the work piece 129 that has been completed, with the thread chain 94 that extends from the trailing edge 198 of completed work piece 129 to the needle and other stitch forming implements. In FIG. 6 stationary knife 112 and the movable knife 116 are located rearwardly of the back edge 14 of the throat plate 10. In FIG. 6 the length of chain 94 that extends from the back edge 38 of chaining tongue 34 to the location where chain 94 is severed by knife blades 112 and 116 is identified by the letter X, which is approximately 0.762 inches or 0.0195 centimeters.

Figure 7:
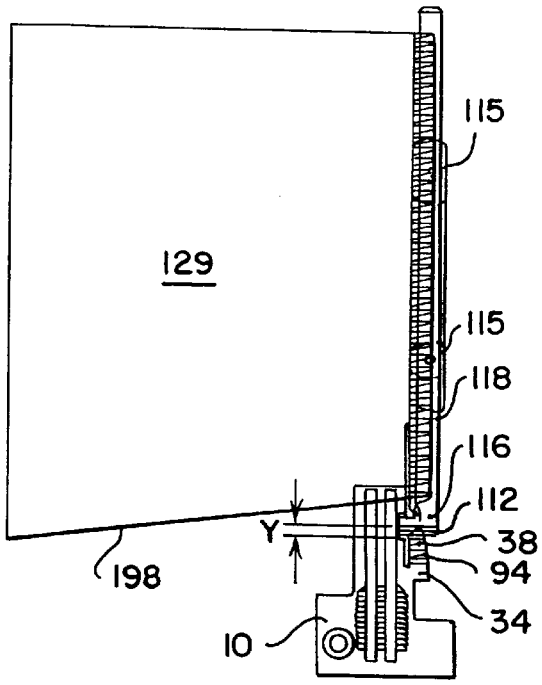
FIG. 7 is a plan view of the preferred embodiment of the latchtacking arrangement of this invention.

FIG. 7 is a top view illustration of the preferred embodiments of this invention in which the blades 112 and 116 of chain cutter 110 have been miniaturized. In this view the throat plate 10, hollow chaining tongue 34 and its back edge 38 are identified. Also identified in this view are the work piece 129 that has been completed, the thread chain 94 that extends from the trailing edge 198 of completed work piece 129 to the needle and other stitch forming implements. In FIG. 7 the stationary knife 112 and movable knife 116 are located at the back edge 38 of the chaining tongue 34. In FIG. 7 the length of chain 94 that extends from the back edge 38 of chaining tongue 34 to the location where chain 94 is severed by knife blades 112 and 116 is identified by the letter Y which is approximately 0.110 inches or 0.0028 centimeters. Thus, in the preferred embodiment the severed chain length has been reduced from 0.762 inches to 0.116 inches. which represents a reduction of 693%. As a result of this reduction it is no longer necessary to stretch the chain before it is cut and the loose unconstrained section of chain extending from the back edge 38 of the chaining tongue to the back edge of the throat plate 10 has been eliminated. The elimination of this loose section of chain has also eliminated the possibility that this loose chain will become snarled or tangled. Furthermore, the length of chain that must be latchtacked into the seam of the next work piece has been greatly reduced which improves the appearance of the finished product.

Figure 8:
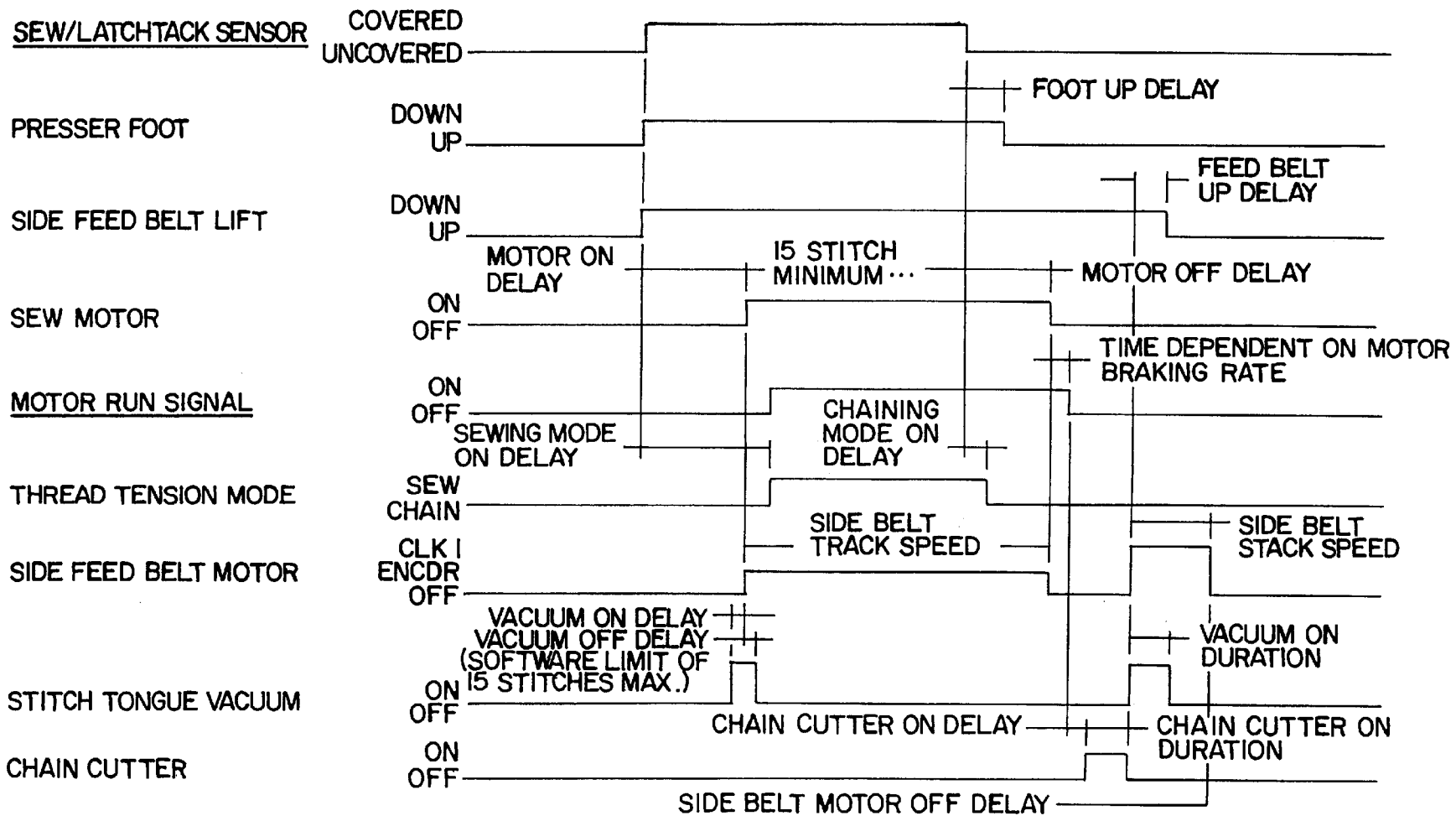
FIG. 8 is a timing diagram for the preferred embodiment of this invention.

FIG. 8 is a timing diagram for the preferred embodiment of this invention and discloses the current best mode of the invention. However, some of the sewing machine components and their sequence of operation are, as disclosed in the current best mode, are not necessary or could be varied without affecting the practice of applicants invention. For example the feed belt could be eliminated or it could remain in the down position throughout the cycle. A column at the left side of this diagram contains the names of a number of the mechanical components that play a roll in the latchtacking process. Each of these components is connected to the sewing machine's central processor. The central processor receives and sends signals to and from the components and can be programmed to send a signal a predetermined time periods after receiving a signal. The time delays can be measured either in units of time or in stitches produced by the sewing machine.

The first component in the timing diagram is labeled SEW/LATCHTACK SENSOR. This sensor is uncovered until a work piece to be stitched approaches the stitch forming region. When the approaching work piece reaches the SEW/LATCHTACK SENSOR the sensor is covered and the sequence begins. The next component is the PRESSER FOOT which is either down or up. When the sensor is covered a signal is sent to the central processing unit which responds by sending a signal to lower the presser foot to the down position. It should be noted that the presser foot is not raised to the up position as soon as the sensor is uncovered, rather there is programmed into the central processing unit a predetermined presser foot up delay. This delay compensates for the time it took the leading edge of the work product to advance from the spot that it covered the sensor to when it reached the stitch forming region. The next component on the left is the side feed belt lift mechanism. The feed belt is one of the mechanisms that feeds the work piece during the seaming process. The feed belt is moved to its down or operative position in response to the work piece covering the sensor. The next component on the left is the SEW MOTOR. The central processing unit is programmed to turn the sew motor on after a predetermined delay following the covering of the sensor. Next, skipping down to the second from last component on the left is the stitch tongue vacuum. The stitch tongue vacuum, also referred to above as the chaining tongue vacuum, is turned on prior to turning on the sew motor. Thus, the stitch chain that was severed from the previous work piece will be drawn into the opening in the chaining tongue before the sew motor is turned on. However, this timing could be changed to cause the stitch chain to be drawn into the chaining tongue at the same time or after the sew motor is turned on. On the column of components at the left of the diagram, following the sew motor is the motor run signal. The motor run signal is delayed a predetermined time period after the sew motor is turned on and stays on for a time period, depending upon its braking rate, after the sew motor is turned off. At, a predetermined time period after the leading edge of the work piece was sensed the THREAD TENSION MODE is changed from chaining to sewing. This change is time to begin at the same time that seaming begins. The THREAD TENSION MODE is changed from sewing to chaining after a predetermined time period. This predetermined time period of course corresponds to the time period or the number of stitches required to completed the seam in the work piece. It should be noted that the presser foot is down at the instant that the thread tension mode is changed to chaining but is raised a very short period thereafter. A signal is then sent to turn the sew motor off. At this time in the cycle the side feed belt is down and running and is thus functioning to convey the work piece. At about the same time that the signal is sent to turn the sew motor off the drive to the side feed belt stops. However, the side feed belt is not raised at this time. As a result the side belt is now functioning to stop movement of the work piece. The motor continues to run for a short time period depending upon its braking rate. It should be noted that when the motor run signal stops the central processing unit knows that the sewing head has stopped. When the central processing unit ceases to receive a motor run signal, the central processing unit sends a signal to actuate the chain cutter. Thus, the chain can not be cut until after the motor run signal has stopped and caused a signal to be sent to actuate the chain cutter. After a predetermined time delay following cutting the chain the STITCH TONGUE VACUUM is again turned on. The STITCH TONGUE VACUUM remains on for a predetermined time period and is then turned off. A complete cycle of stitching a work piece beginning with a latchtack has now been completed.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A method of cutting the stitch chain formed after completing a seam on a work piece and latchtacking the remaining severed stitch chain on the next work piece to be sewn comprising the steps of:

(1) sensing the leading edge of a work piece to be sewn;

(2) after a predetermined time following step (1), turning on a chaining tongue vacuum;

(3) after a predetermined time delay after step (2), sending a signal to turn on a sew motor;

(4) before a motor run signal initiated by step (3) causes sewing to commence turning the chaining tongue vacuum off;

(5) sending an off signal to the sew motor;

(6) after a predetermined time delay after the signal sent in step (5) has stopped the sew motor, a chain cutter is actuated;

(7) after the chain has been cut by step (6),turning the chaining tongue vacuum on;

(8) after a predetermined time delay, turning the chaining tongue vacuum off.

2. A method of cutting the stitch chain formed after completing a seam on a work piece and latchtacking the severed stitch chain on the next work piece to be sewn comprising the steps of:

(1) sensing the leading edge of a work piece to be sewn;

(2) lowering the presser foot;

(3) after a predetermined time following step (1), turning on a chaining tongue vacuum;

(4) after a predetermined time delay after step (3), sending a signal to turn on a sew motor;

(5) before the motor run signal initiated by step (4) causes sewing to commence, turning the chaining tongue vacuum off;

(6) after a predetermined time delay following step (7), raising the presser foot;

(7) after a predetermined time delay following step (6), sending an off signal to the sew motor;

(8) after a predetermined time delay after the signal sent in step (7) has stopped the sew motor, actuating a chain cutter;

(9) after the chain has been cut by step (8), turning the chaining tongue vacuum on;

(10) after a predetermined time delay, turning the chaining tongue vacuum off.

3. A method of cutting the stitch chain formed after completing a seam on a work piece and latchtacking the severed stitch chain on the next work piece to be sewn comprising the steps of:

(1) sensing the leading edge of a work piece to be sewn;

(2) after a predetermined time following step (1), turning on the chaining tongue vacuum;

(3) after a predetermined time delay after step (2), sending a signal to turn on the sew motor;

(4) after a predetermined time delay after step (3), sending a signal to adjust the needle thread tensioner for sewing;

(5) before the motor run signal initiated by step (3) causes sewing to commence, turning the chaining tongue vacuum off;

(6) after a predetermined time delay following sensing the leading edge of the work piece to be sewn, adjusting the needle thread tension to chaining;

(7) sending an off signal to the sew motor;

(8) after a predetermined time delay after the signal sent in step (7) has stopped the sew motor, actuating the chain cutter;

(9) after the chain has been cut by step (8), turning the chaining tongue vacuum on;

(10) after a predetermined time delay turning, the chaining tongue vacuum off.

4. A method of cutting the stitch chain formed after completing a seam on a work piece and latchtacking the remaining severed stitch chain on the next work piece to be sewn comprising the steps of:

(1) sensing the leading edge of a work piece to be sewn;

(2) lowering a presser foot;

(3) after a predetermined time following step (1), turning on a chaining tongue vacuum;

(4) after a predetermined time delay after step (3), sending a signal to turn on a sew motor;

(5) after a predetermined time delay after step (4), sending a signal to adjust a needle thread tensioner for sewing;

(6) before the motor run signal initiated by step (4) causes sewing to commence, turning the chaining tongue vacuum off;

(7) after a predetermined time delay following sensing the leading edge of the work piece to be sewn, adjusting the needle thread tension to chaining;

(8) after a predetermined time delay following step (7), raising the presser foot;

(9) after a predetermined time delay following step (8), sending an off signal to the sew motor;

(10) after a predetermined time delay after the signal sent in step (9) has stopped the sew motor, actuating the chain cutter;

(11) after the chain has been cut by step (10), turning the chaining tongue vacuum on;

(12) after a predetermined time delay, turning the chaining tongue vacuum off.

5. A vacuum latchtack throat plate and stitch chain cutter comprising:

a throat plate body having a front edge and a side edge;

a chaining tongue integrally formed with said throat plate body and extending in a direction generally parallel to the side edge of said throat plate body, the chaining tongue comprising a back edge and an internal bore beginning at the back edge and extending longitudinally along a first axis;

a conduit coupling said internal bore to the front edge of said throat plate body, wherein the conduit is angled from said first axis; and a stitch chain cutter located at said back edge of the chaining tongue adjacent the beginning of said internal bore.

6. A vacuum latchtack throat plate and stitch chain cutter comprising:

a throat plate body having a front edge and a side edge;

a chaining tongue integrally formed with said throat plate body and extending in a direction generally parallel to the side edge of the throat plate body, the chaining tongue comprising a back edge and an internal bore beginning at the back edge and extending longitudinally along a first axis;

a conduit coupling said internal bore to said front edge of the body; and a stitch chain cutter located at said back edge of the chaining tongue adjacent the beginning of said internal bore.

7. A throat plate and stitch chain cutter comprising:

a throat plate body having a first internal bore beginning at an edge of the body and extending through a portion of the body;

a channel formed in a lower surface of said throat plate body and having one end coupled with the first internal bore;

a chaining tongue comprising a back edge and a second internal bore beginning at said back edge and extending longitudinally to the other end of the channel; and a stitch chain cutter located at said back edge of the chaining tongue adjacent the beginning of said second internal bore.

* * * * *